US006171089B1

(12) United States Patent
Oehman, Jr.

(10) Patent No.: US 6,171,089 B1
(45) Date of Patent: Jan. 9, 2001

(54) EXTERNAL GEAR PUMP WITH DRIVE GEAR SEAL

(75) Inventor: Robert E. Oehman, Jr., Apex, NC (US)

(73) Assignee: Parker-Hannifin Corporation, Cleveland, OH (US)

( * ) Notice: Under 35 U.S.C. 154(b), the term of this patent shall be extended for 0 days.

(21) Appl. No.: 09/286,963

(22) Filed: Apr. 6, 1999

Related U.S. Application Data

(60) Provisional application No. 60/085,116, filed on May 12, 1998.

(51) Int. Cl.[7] ..... F04C 2/20

(52) U.S. Cl. ..... 418/75; 418/144; 418/191; 418/206.4; 418/206.6

(58) Field of Search ..... 418/144, 191, 418/206.6, 206.1, 142, 75, 206.4

(56) References Cited

U.S. PATENT DOCUMENTS

| | | | | |
|---|---|---|---|---|
| 2,818,023 | | 12/1957 | Lundstrom . | |
| 3,120,190 | * | 2/1964 | Schmitter et al. | 418/144 |
| 3,179,331 | * | 4/1965 | Paschke et al. | 418/142 |
| 3,251,309 | | 5/1966 | Schmiel et al. . | |
| 3,499,390 | | 3/1970 | Prijatel . | |
| 3,802,813 | | 4/1974 | Butler | 418/165 |
| 4,277,230 | | 7/1981 | Müller | 418/131 |
| 5,096,396 | * | 3/1992 | Welch | 418/206.6 |
| 5,496,163 | | 3/1996 | Griese et al. | 418/200 |
| 5,522,714 | | 6/1996 | Orimo et al. | 464/154 |
| 5,586,875 | | 12/1996 | Ondrejko et al. | 418/3 |

FOREIGN PATENT DOCUMENTS

| | | | | |
|---|---|---|---|---|
| 1956528 | * | 5/1971 | (DE) | 418/142 |
| 1320674 | * | 1/1963 | (FR) | 418/142 |

* cited by examiner

*Primary Examiner*—John J. Vrablik
(74) *Attorney, Agent, or Firm*—Christopher H. Hunter

(57) ABSTRACT

A metering pump includes a set of externally-toothed gears, with a first of the gears, the drive gear, having a central opening to receive a drive shaft. The gears are supported within a housing defined between first and second housing plates. The first and second housing plates each have central openings aligned with the central opening in the drive gear, and inner wall surfaces adjacent opposite side surfaces of the gears. The first and second gears are rotatably supported within the housing such that the rotational axis of the gears are parallel to one another, and certain of the gear teeth intermesh together when the gears rotate. A first port in the housing provides an inlet fluid flow to an inlet side of the meshing gear teeth, while a second port provides an outlet fluid flow from an outlet side of the meshing teeth. An annular resilient, face-type lip seal is disposed against each side surface of the drive gear, surrounding the central opening in the gear. The lip seals are located in annular grooves formed in the opposing surfaces of the adjacent housing plates surrounding the central openings in the plates, and fluidly seal to the respective surfaces of the first gear during rotation of the gears to prevent fluid leakage into the central opening in the gear.

11 Claims, 6 Drawing Sheets

EXTERNAL GEAR PUMP WITH DRIVE GEAR SEAL

RELATED CASES

The present application claims priority to U.S. Provisional Application Serial No.60/085,116; filed May 12, 1998.

FIELD OF THE INVENTION

The present invention relates generally to precision metering pumps, and more particularly to external gear metering pumps for pumping viscous materials.

BACKGROUND OF THE INVENTION

Small precision metering pumps, designed for metering, for example, viscous materials such as hot melt adhesive or molten nylon or other polymers, in certain applications include a housing enclosing a pair of circular gears with external, intermeshing teeth. The gears are disposed within a pump cavity between a pair of housing plates, with the side surfaces of the gears in direct, sealed engagement with the plates to prevent internal fluid leakage between the high and low pressure zones in the pump cavity. Fixed thrust or wear plates are sometimes provided between the gear plates and the housing plates to reduce or eliminate wear and provide the necessary fluid seal. Various vents and grooves have been provided in the plates to balance the plates against the gears.

Inlet and outlet passages in the housing direct the viscous material into and out of discharge grooves formed in the surface of one or both plates, adjacent the intermeshing teeth, so that the gears meter the viscous fluid upon rotation. One of the gears (the drive gear) rotates on a drive shaft permanently mounted within the housing and extending outwardly therefrom. The drive shaft is typically journaled on a bushing mounted within the housing for smooth rotation of the gears over a range of operating torques and pressures. Appropriate O-seals supported by the housing seal around the drive shaft to prevent fluid from leaking out of the pump, and contaminants from entering the pump. The drive shaft is remotely connected to the drive shaft of a motor (prime mover), typically by a female-to-female connector.

The other, secondary gear of the set can be mounted for example, on a fixed stud or arbor supported between the housing plates. For more viscous materials, the secondary gear may also be driven by a second drive shaft permanently mounted within the housing, journaled on a second bushing, and remotely connected to a second prime mover. The stud for the secondary gear is supported generally parallel to the drive shaft for the drive gear. Alternatively, or in addition, a second set of circular gears can be provided, with external teeth, mounted adjacent the first set of gears in the same manner as described above. Such a second set of gears also facilitates pumping highly viscous material through the pump.

U.S. Pat. Nos. 2,818,023; 3,499,390; 4,277,230 and 5,496,163, for example, illustrate metering pumps such as described above.

While the precision metering pumps described above have been found appropriate for many applications, it is believed that the pumps are still too large for some applications, and that the industry has been demanding still further reductions in size. The use of a pump drive shaft and associated bushings, while heretofore believed necessary, serve to increase the over-all size of the pump. In some applications, a substantial number of pumps are mounted together on large spinning or processing machines, and the size of each pump can be an impediment to reducing the over-all size (and cost) of the machines.

As such, it is believed that there is a demand in the industry for an improved precision metering pump which has a reduced size, and which still operates effectively over a broad range of operating conditions. It is also believed there is a continual demand in the industry for metering pumps of a compact size which are easy to manufacture and assemble, and which are reliable over a long operating lifetime.

SUMMARY OF THE PRESENT INVENTION

The present invention provides a new and unique metering pump for viscous liquids which operates effectively over a broad range of operating pressures and torques. The pump does not require a permanent drive shaft and associated bushings, which significantly reduces the overall size of the pump. The pump is also manufactured from few parts, which makes the pump easy to assemble and maintain, and provides a long operating lifetime.

According to the present invention, the metering pump includes a pair of externally-toothed gears rotatably supported between a pair of housing plates. A gear plate with appropriate openings for the gears is interposed between the housing plates, and surrounds the gears. The gears are supported such that certain teeth of the gears intermesh in a gear chamber. The housing plates each include a central opening. A first of the gears, the drive gear, also includes a central opening, aligned with the central openings in the housing plates. The central opening in the drive gear can have splines or teeth, to directly receive the drive shaft of a motor or other prime mover inserted through the central opening in one of the housing plates, and allow rotation of the drive gear by the prime mover.

An annular face-type seal bounds the central opening in the drive gear, on each side surface of the gear. The face-type seal has a U-shape in cross section, and opens radially outward, with one wall of the seal in sealing engagement with the drive gear side surface, and the other wall of the seal in sealing engagement with the associated housing plate surface. The face seal can be located in an annular channel or groove formed in the housing plate, surrounding the central opening in the plate, and a corresponding shallow annular channel can be formed on the gear surface. The face seal prevents fluid leaking from the high pressure zone of the gear cavity into the central opening of the drive gear, that is, into the drive shaft receiving cavity of the pump.

The drive gear engages the inside surface of the opening in the gear plate surrounding the gear during rotation, which the gear uses as a bearing surface. The diameter of the drive gear spreads the load over a substantial portion of the gear to reduce wear on the gear. Pressure balancing grooves on the opposing faces of the housing plates, and pockets in the gear plate formed in the area of the intermeshing teeth, also reduce the loading on the drive gear during rotation. The drive shaft of the prime mover can be inserted into, or removed from, the central opening of the drive gear without disassembly of the housing.

The metering pump of the present invention has a reduced, compact size as the drive shaft of the prime mover is connected directly to the drive gear of the pump. There is no internal drive shaft or bushings necessary for the pump, which reduces the overall size of the pump without affecting the functionality of the pump. The metering pump effectively pumps fluid across a range of operating pressures and torques, and has a long operating lifetime. Because of the reduced number of components in the pump, the pump is easy to manufacture and maintain.

Further features of the present invention will become apparent to those skilled in the art upon reviewing the following specification and attached drawings.

DETAILED DESCRIPTION OF THE PREFERRED EMBODIMENT

Figure 1:
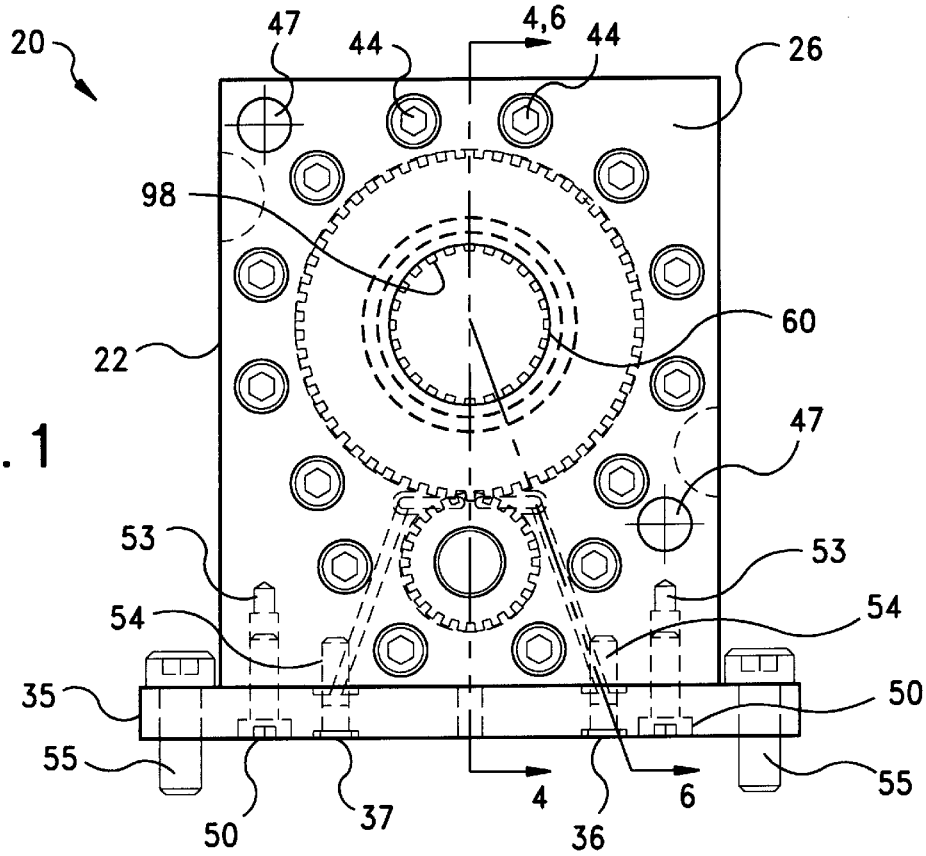
FIG. 1 is a front view of a metering pump constructed according to the principles of the present invention.
Figure 3:
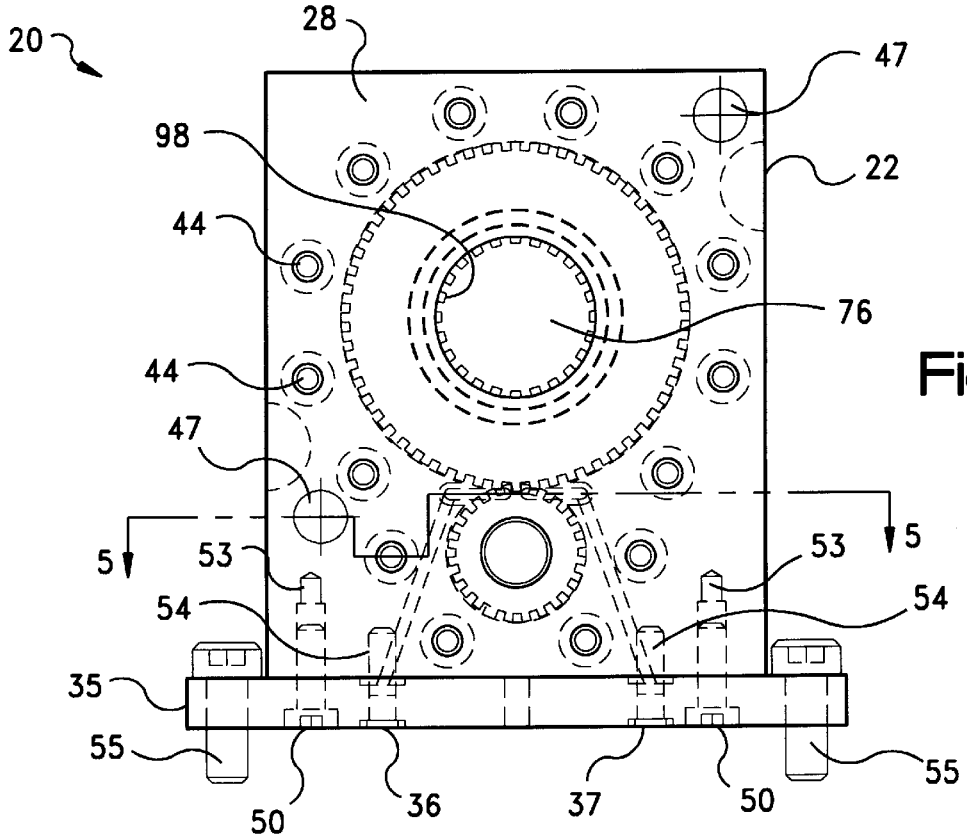
FIG. 3 is a rear view of the metering pump of FIG. 1.
Figure 8:
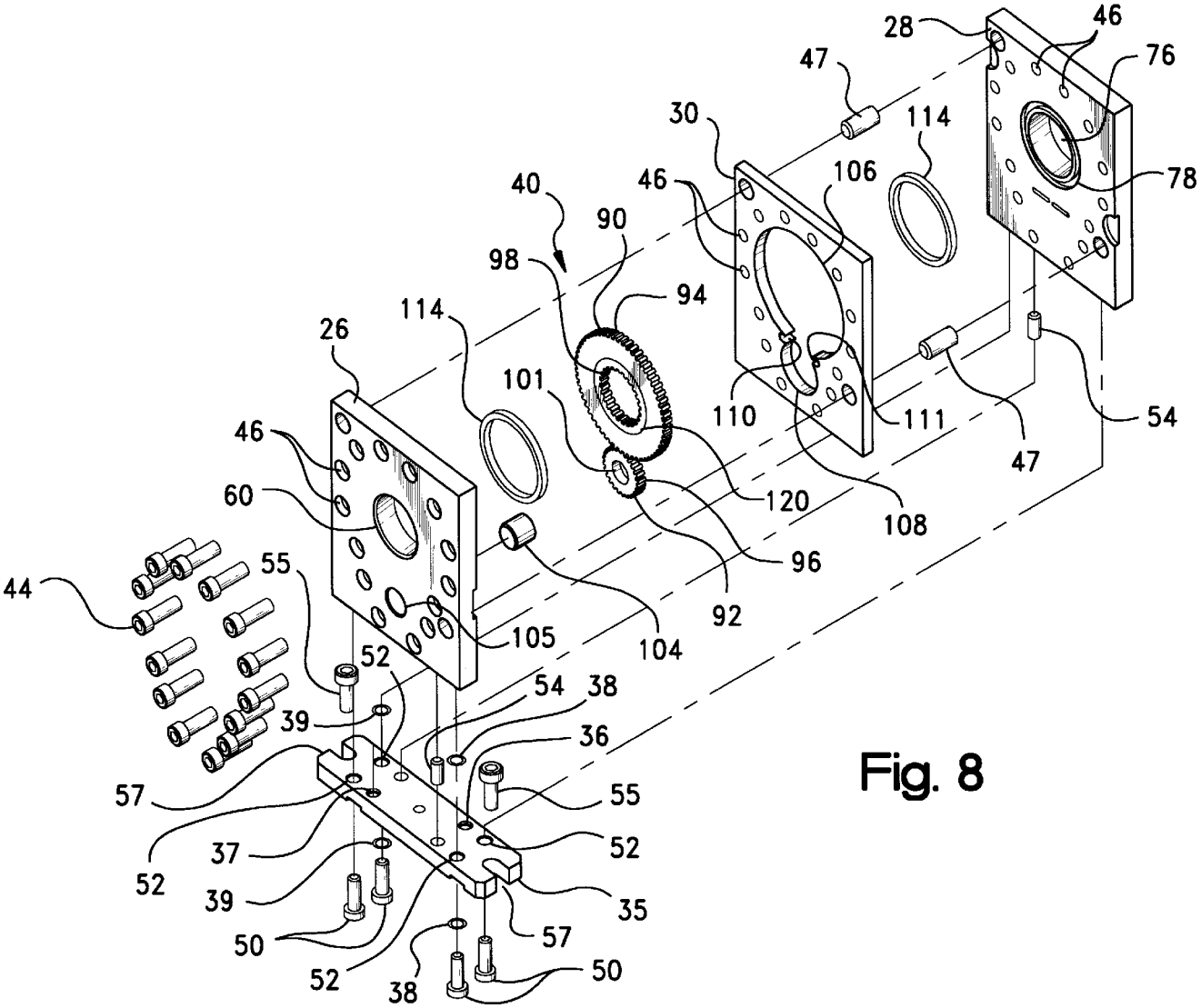
FIG. 8 is an exploded view of the various components of the metering pump of FIG. 1.
Figure 9:
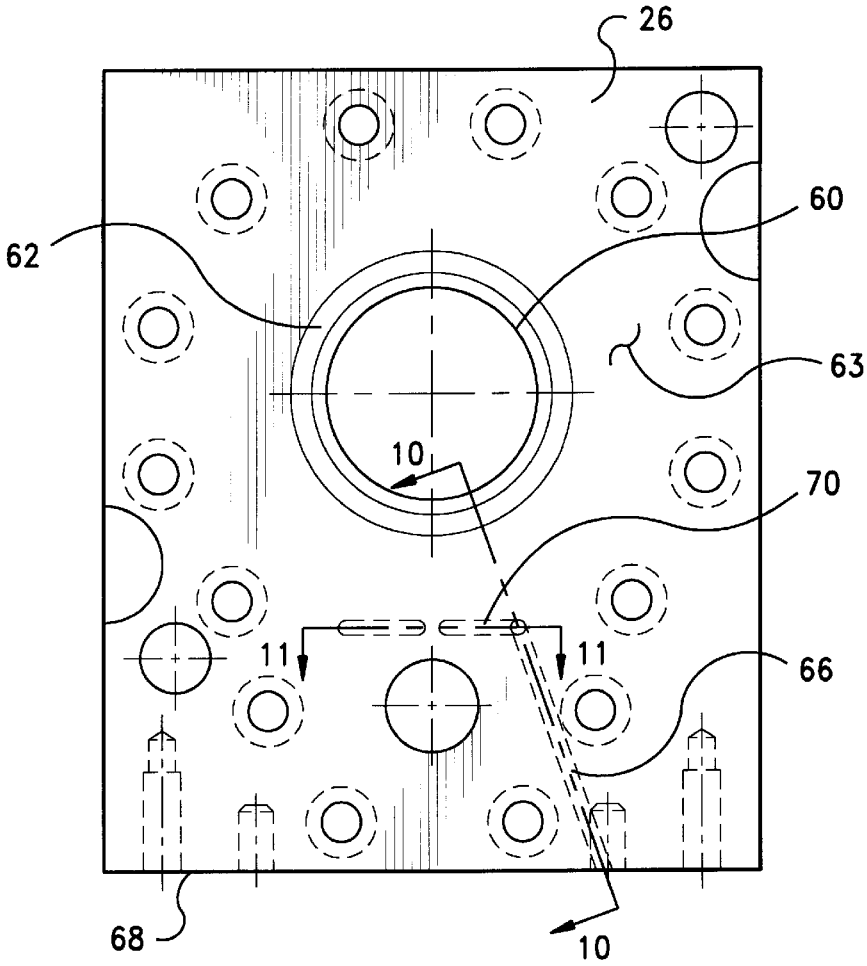
FIG. 9 is a rear view of the front plate for the metering pump.
Figure 10:
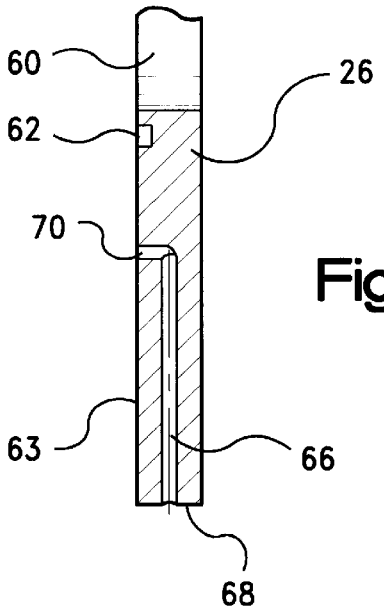
FIG. 10 is a cross sectional side view of the front plate taken substantially along the plane described by the lines 10—10 of FIG. 9.
Figure 11:
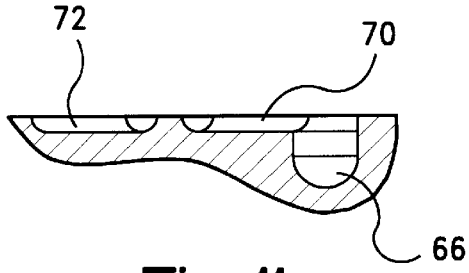
FIG. 11 is a sectional view of the front plate taken substantially along the plane described by the lines 11—11 of FIG. 9.
Figure 12:
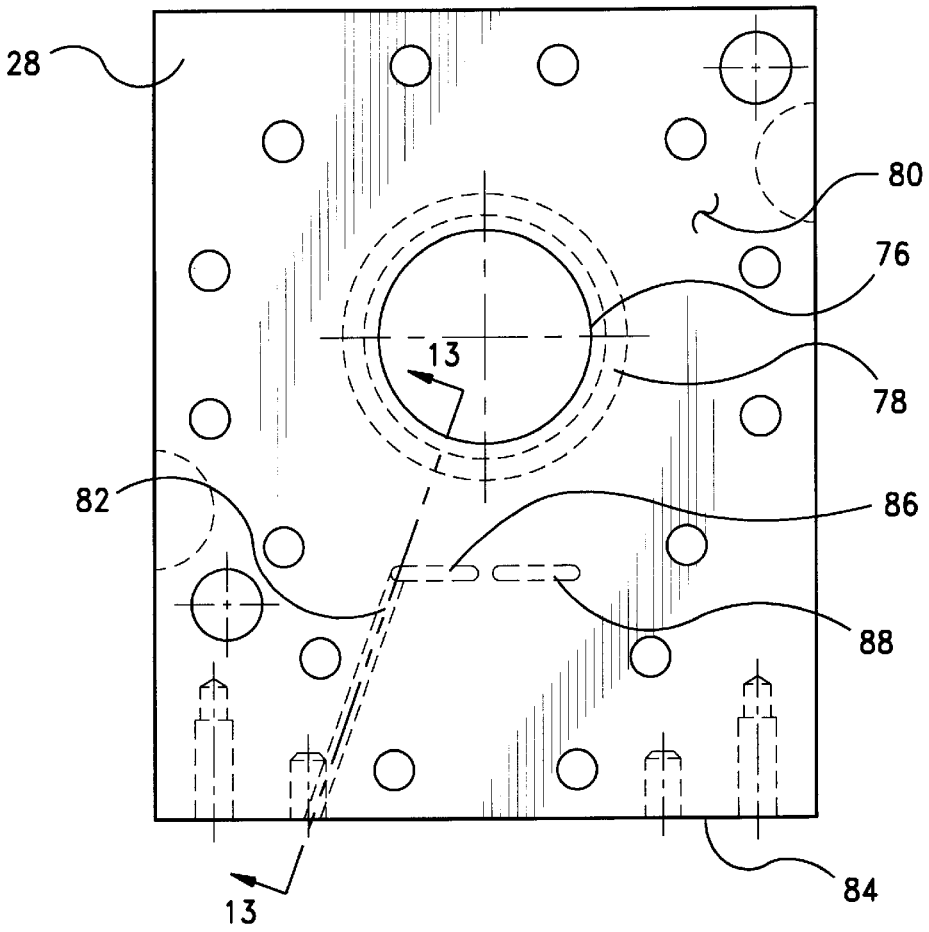
FIG. 12 is a front view of the rear plate for the metering pump.
Figure 13:
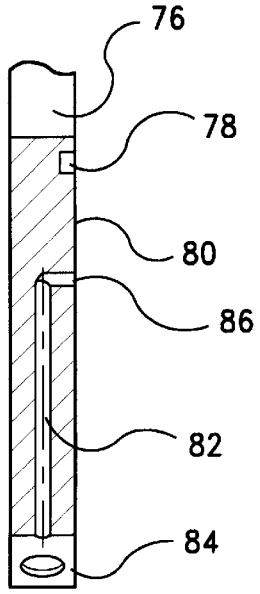
FIG. 13 is a cross sectional side view of the rear plate taken substantially along the plane described by the lines 13—13 of FIG. 12.

Referring to the drawings, and initially to FIGS. 1, 3 and 8, a metering pump constructed according to the principles of the present invention is indicated generally at 20. The metering pump 20 includes a pump housing 22 consisting of a front housing plate 26, a rear housing plate 28, an intermediate gear plate 30 disposed between front plate 26 and rear plate 28, and a lower base plate 35. Base plate 35 includes inlet port 36 and outlet port 37 for the pump housing 22, and O-rings 38, 39, respectively, are disposed within these ports for fluidly-sealing with external components. Disposed between front plate 26 and rear plate 28 is a gear set, indicated generally at 40, which meters fluid provided through inlet and outlet ports 36, 37, as will be described herein in more detail.

Front plate 26, rear plate 28 and gear plate 30 are each preferably formed of a relatively thin sheet or block of appropriate rigid, long-lasting material, such as alloy steel. Front plate 26, rear plate 28 and gear plate 30 are fastened together in fluid-tight, surface-to-surface relation with one another using a plurality of fasteners (e.g., nuts and bolts), such as indicated at 44. Fasteners 44 are received within through-bores as at 46, spaced around the plates 26, 28 and 30. Metal dowels 47 extend from front plate 26 to rear plate 28, and through gear plate 30, for properly aligning the plates together during assembly and supporting the plates during operation.

Figure 2:
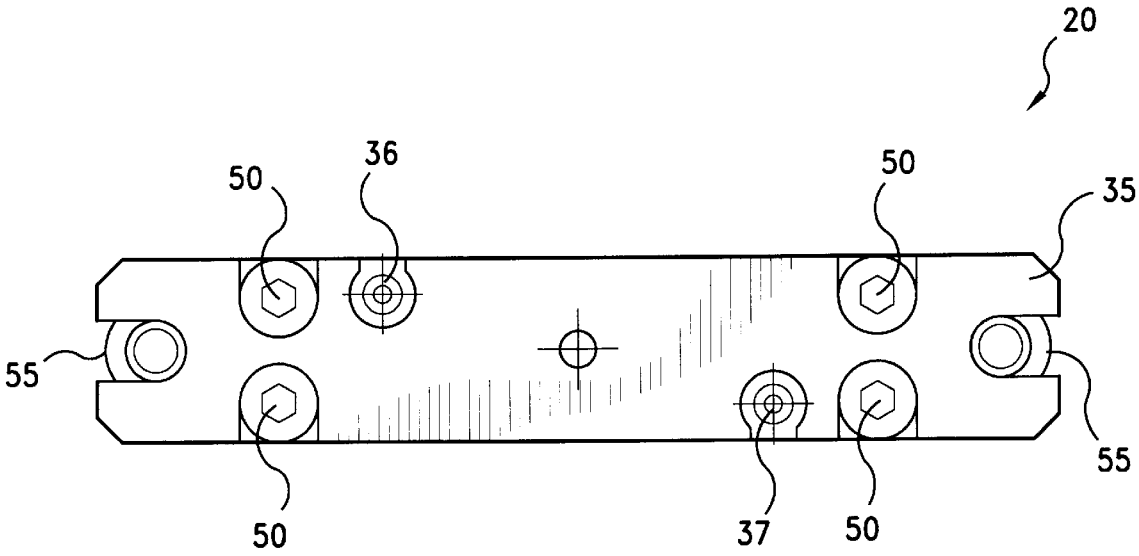
FIG. 2 is a bottom view of the metering pump of FIG. 1.
Figure 6:
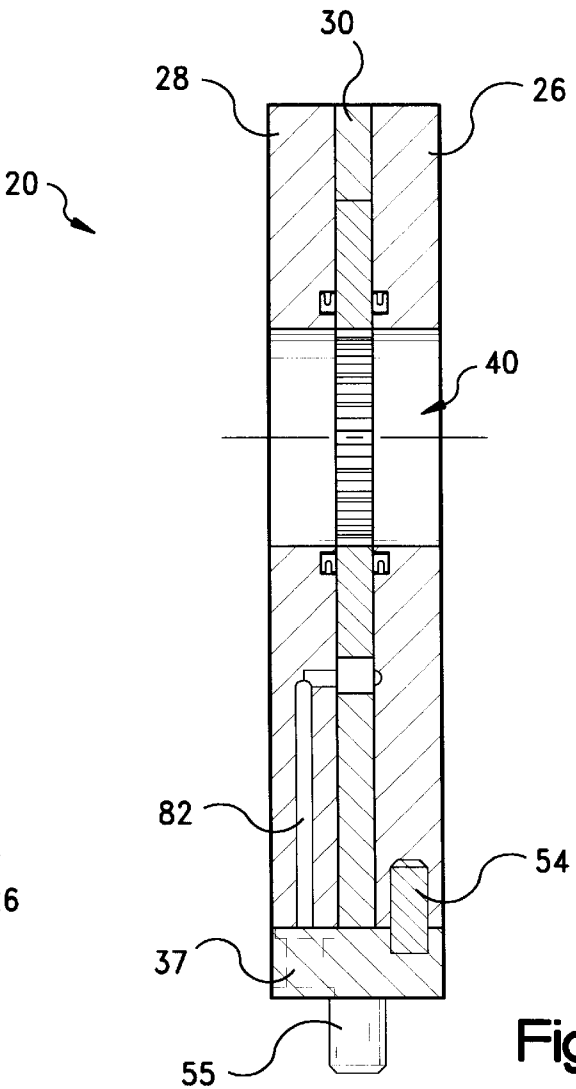
FIG. 6 is a cross-sectional view of the metering pump taken substantially along the plane described by the lines 6—6 of FIG. 1.

As also shown in FIG. 2, base plate 35 is also preferably formed from a block of alloy steel and attached to the bottom end of housing 22 with a plurality of fasteners 50 (e.g., bolts), received in through-holes 52 in base plate 35 and corresponding bores 53 in front plate 26 and rear plate 28. As also shown in FIG. 6, metal dowels 54 extend from front plate 26 and rear plate 28 and into base plate 35 for properly aligning the plates together during assembly and supporting the plates during operation. Fasteners 55 (e.g., bolts) are received within bores 57 in the base plate and allow base plate 35, and hence pump 20, to be attached to a support surface within the pump system.

Figure 5:
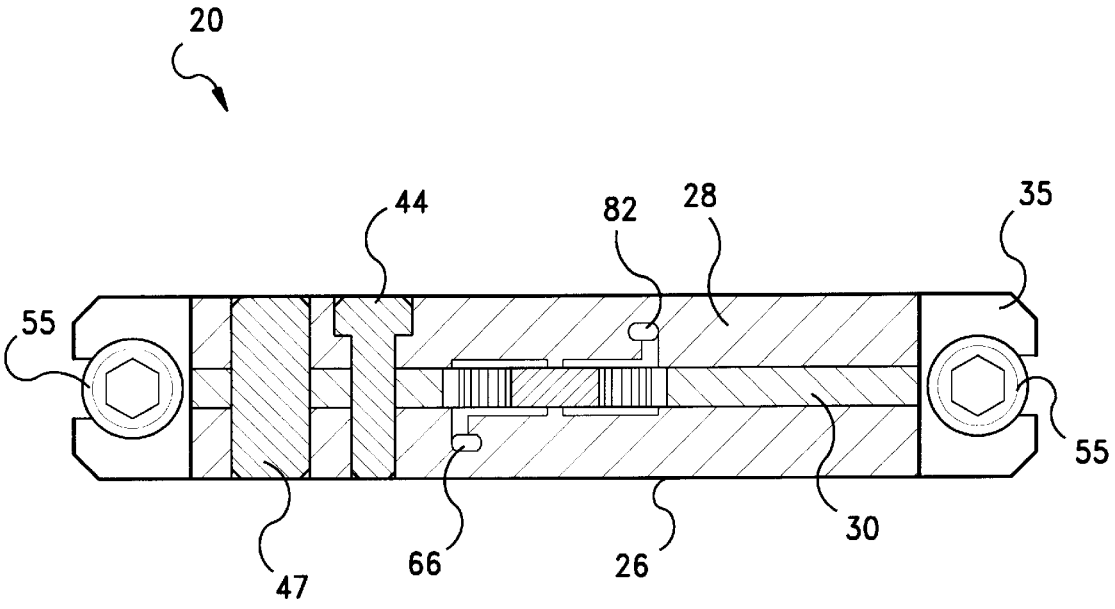
FIG. 5 is a cross-sectional view of the metering pump taken substantially along the plane described by the lines 5—5 of FIG. 3.

As shown in FIGS. 1 and 8–11, front plate 26 includes a central circular opening 60, and an annular channel or groove 62, closely surrounding the circular opening 60, on the inside surface 63 of plate 26, that is, facing inwardly toward rear plate 28. As also shown in FIG. 5, a bore 66 is formed (e.g., drilled) inwardly from the bottom end 68 of plate 26, to a discharge groove 70 opening into the inside surface 63 of the plate. When assembled with base plate 35, the lower end of bore 66 is aligned with outlet port 37 for fluid communication therewith. An upper of the O-rings 39 provides a fluid seal between bore 66 and outlet port 37. As will be explained in more detail below, discharge groove 70 extends generally horizontally inward from the upper distal end of bore 66 toward the centerline of the front plate 26. A similar groove 72 (not connected to bore 66) is formed in surface 63 symmetrically arranged on the other side of the centerline of the plate for pressure balancing purposes.

Rear plate 28 is similar to front plate 26, and as shown in FIGS. 3, 8, 12 and 13, includes a central circular opening 76, and an annular channel or groove 78, closely surrounding the circular opening 76, on the inside surface 80 of plate 28, that is, facing inwardly toward front plate 26. As also shown in FIGS. 5 and 6, a bore 82 is formed (e.g., drilled) inwardly from the bottom end 84 of plate 28, to a discharge groove 86 opens into the inside surface 80 of the plate. When assembled with base plate 35, the lower end of bore 82 is aligned with inlet port 36 for fluid communication therewith. An upper of the O-rings 38 provides a fluid seal between bore 82 and inlet port 36. As will also be explained in more detail below, discharge groove 86 extends generally horizontally inward from the upper distal end of bore 82 toward the centerline of the rear plate 28. A similar groove 88 (not connected to bore 82) is formed in surface 80 symmetrically arranged on the other side of the centerline of the plate for pressure balancing purposes.

Referring again to FIG. 8, the gear set 40 includes a first gear 90, referred to as a drive gear, and a second gear 92, referred to as a secondary gear. Drive gear 90 includes a series of teeth 94 disposed evenly around the exterior of the gear, while the secondary gear 92 likewise includes a series of teeth 96 disposed evenly around the exterior of the gear. Drive gear 90 is preferably of a significantly larger diameter than secondary gear 92 because, as will be described below, this gear also serves as part of the bearing for the pump. The relative dimensions of the drive gear and secondary gear are chosen depending upon the particular application. The thickness of the gears is chosen so as to provide appropriate rigidity and wear resistance over time, as well as to minimize the overall thickness of the pump housing. The gears are formed from appropriate rigid material, for example a metal such as steel alloy.

Drive gear 90 includes a central circular opening 98 which is designed to receive a drive shaft "D" (FIG. 7) from a prime mover, e.g. a motor. Central opening 98 in drive gear 90 is aligned with central opening 60 in front plate 26, and central opening 76 in rear plate 28, when these components are assembled together. The drive shaft can be inserted in through opening 60 in front plate 26, or alternatively, through opening 76 in rear plate 28, depending upon the direction of the housing, without disassembly of the housing. It is also anticipated that only one plate may have an opening to receive the drive shaft. In any case, the drive shaft is received in opening 98 in the drive gear and supported entirely by its remote bearing or bushing structure in the prime mover, that is, there is no structure internal to the pump housing which supports the drive shaft other than the direct connection with the drive gear. The central opening 98 in drive gear 90 can have appropriate splines, teeth, etc. which would engage corresponding geometry on the drive shaft to directly couple these two components together.

The secondary gear 92 likewise includes a central opening 101 which is designed to receive an arbor or stud 104. Arbor 104 is fixedly mounted in an opening 105 in front plate 26 (see also FIG. 4), and opening 101 in secondary gear 92 is dimensioned to allow the secondary gear to freely rotate around this arbor. The secondary gear 92 rotates on arbor 104 around an axis which is preferably parallel to the axis of the drive gear 90 rotating on the drive shaft.

The gear set is received within an open portion of gear plate 30, with the drive gear 90 supported between the plates in the same plane as secondary gear 92. The gears 90, 92 are supported such that certain of the teeth 94 of drive gear 90 intermesh with certain of the teeth 96 of secondary gear 92. To this end, gear plate 30 includes a major opening 106 and a minor opening 108. Major opening 106 is dimensioned to closely receive drive gear 90, while minor opening 108 is dimensioned to closely receive secondary gear 92. The major and minor openings closely bound the respective gears, but have sufficient clearance to allow smooth rotation thereof. The major and minor openings 106, 108 intersect at the point where the teeth of gears 90, 92 intermesh. In the area of intersection, a gear teeth chamber or pocket is formed by the opposite inner side surfaces 63, 80 of the front and rear plates 26–28 in this area, and small, semi-circular curved pockets 110, 111, formed at the intersection of the major and minor openings, opening inwardly toward the intermeshing teeth, and smoothly intersecting the major and minor openings.

Pockets 110, 111 provide pressure balancing for the gear set during operation. The inlet discharge groove 86 in rear plate 28 is oriented to direct fluid inwardly between the plates at the location of one of the pockets 110 (the pocket to the left in FIG. 8), while the outlet discharge groove 70 in front plate 26 is oriented to receive fluid from the plates at the location of the other of the pockets 111 (the pocket to the right in FIG. 8). The grooves 72, 88, being disposed on the opposite side of the drive gear from discharge grooves 70, 86, respectively, also provide a pressure-balancing function for the gear.

As should be known to those skilled in the art, the fluid introduced through inlet discharge groove 86 in rear plate 28 into an inlet side of the gear teeth chamber is drawn by the teeth on the rotating gears around the periphery of both gears, that is, between the gear teeth and the wall surface defining the major and minor openings surrounding the gears. When the fluid reaches the far side of the gears, the fluid is directed into an outlet side of the gear teeth chamber and is directed through the outlet discharge groove 70 in front plate 26. The rotation of the gears thereby draws or "pumps" the fluid through the housing from inlet port 36 to outlet port 37. The spacing between grooves 70, 72 in front plate 26, and grooves 86, 88 in rear plate 28, along with the close fit of the intermeshing teeth, prevents significant fluid flow directly between the gears, but rather requires the fluid to pass around the periphery of the gears. Inlet pressure is provided around essentially the entire gears. Inlet ports and outlet ports could of course be reversed, and the gear rotation reversed, to direct the fluid in the opposite direction through the pump.

As indicated previously, the front and rear housing plates 26, 28 are preferably disposed closely adjacent the gears 90, 92 of the gear set, and preferably have less than 0.0005 inches clearance on each side surface between the gears and the adjacent plate surface. The gears are also closely bounded by the major and minor openings, with the clearance preferably less than 0.001 inches between the outer tips of the gears and the inside diameter of the openings. The drive gear 90 uses the inside diameter of the major opening 106 as a bearing surface during rotation because of the pressures in the system, and can engage the wall surface defining this opening during rotation. Preferably the diameter of the drive gear is maximized so as to spread the load around a substantial portion of the gear. The pressure-loading grooves minimize or at least reduce the loading of the drive gear during rotation.

Figure 7:
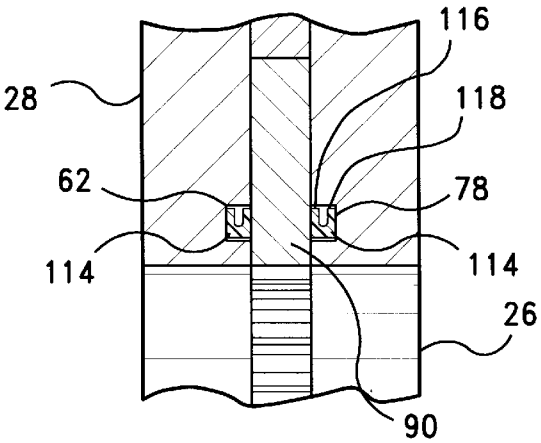
FIG. 7 is a enlarged view of a portion of the metering pump shown in FIG. 4.
Figure 4:
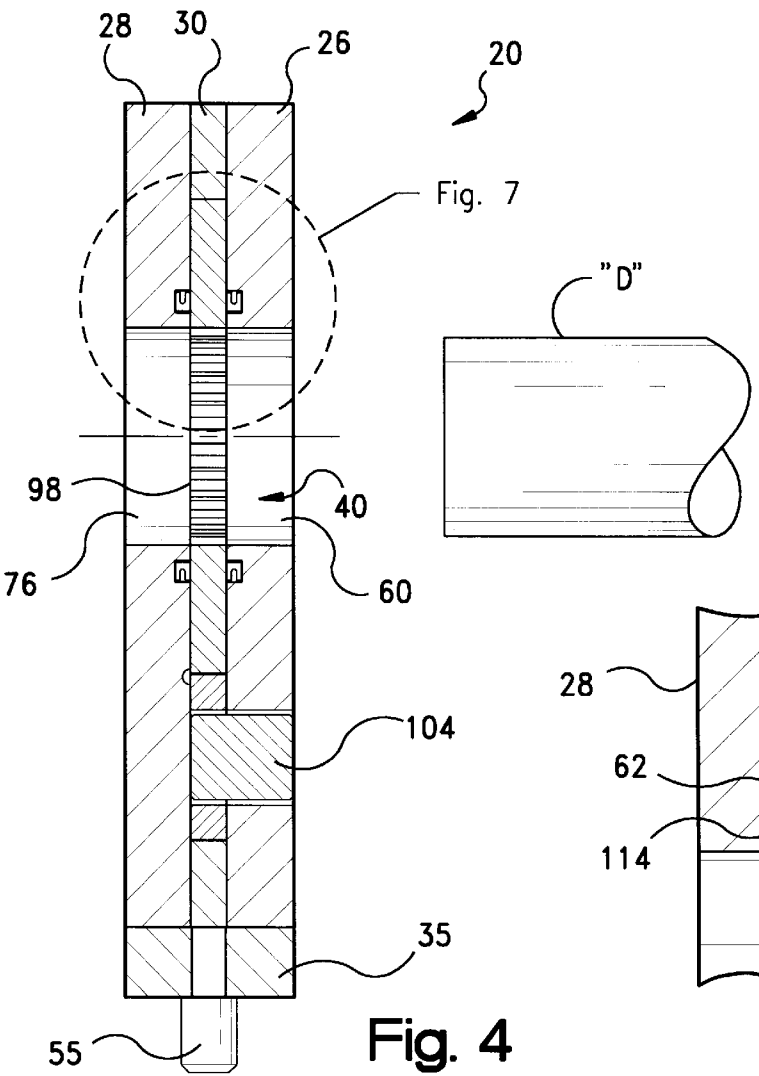
FIG. 4 is a cross-sectional view of the metering pump taken substantially along the plane described by the lines 4—4 of FIG. 1.

The gears 90, 92 are fluidly sealed within the housing around their outer periphery by the fasteners 44 which tightly hold the plates together. The drive gear 90 is fluidly sealed around the central opening 98, that is, sealed from the receiving cavity for the drive shaft, by a pair of annular resilient sealing elements 114, one of which is disposed on each side of the drive gear bounding the central opening 98, as shown in FIGS. 4 and 7. The sealing elements 114 are preferably identical, and comprise spring-energized, face-type lip seals which are disposed within the annular channels 62, 78 formed in the opposed adjacent surfaces of the front and rear plates 26, 28, respectively. As shown most clearly in FIG. 7, each sealing element 114 has a U-shape in cross section, and opens radially-outwardly from the central axis of the drive gear. Each sealing element includes an inner wall such as at 116, which engages in surface-to-surface contact and fluidly-seals against an outer side surface of the drive gear 90; and an outer wall such as at 118, which also engages in surface-to-surface contact and fluidly seals against the respective adjacent housing plate, along the inside wall surface of the channel. A shallow annular channel as at 120 (see FIG. 8) can be formed in the side surfaces of the drive gear to receive the inner wall 116 of the sealing element. Such a shallow channel may further improve the sealing characteristics of the sealing element against the drive gear.

The sealing elements 114 having a lip-seal type configuration are commercially available from a number of sources, including the assignee of the present invention. Such seals are preferably formed from an elastomeric material such as PTFE, EPDM, or other appropriate material. The outwardly-opening configuration energizes the seals if fluid leaks inwardly between the housing plates and the drive gear surfaces during rotation of the gears, thereby preventing fluid leaking inwardly into the cavity for the drive shaft. As can be seen from the illustration in FIG. 7, the sealing elements are contained entirely within the grooves in their respective housing plates, and are not in contact with the drive shaft when the drive shaft is inserted into the central opening in the drive gear. The particular dimensions and material of the sealing elements is dependent upon the particular application, and can easily be determined using simple experimentation.

Using the principles of the present invention, a metering pump was constructed where the pump was capable of receiving an inlet pressure of 100 to 600 psi; and was capable of delivering up to 1000 psi discharge pressures. The drive gear was driven at 100 RPM. The driving gear had 76 teeth and was rated at 1.46 cc/rev. The secondary gear had 26 teeth, and was similarly rated. The pump housing had the following dimensions:

Width (side-to-side): 3.875 inches

Thickness (front-to-back): 0.864 inches

Height: 5.125 inches (4.755 inches without base 35)

As should be appreciated, such a small housing is exceptional for metering pumps of this capacity, and would allow a number of metering pumps to be mounted in a small area. There was essentially no fluid leakage into the central opening 76 in the drive gear, that is, into the drive shaft receiving cavity. There was also no leakage externally between the plates.

Of course, it should be noted that the above is only one example of operating parameters and dimensions for the metering pump, and/or dimensions and parameters are possible. It is believed that the pump will operate across of range of operating conditions, that is from low inlet/high outlet pressures, to high inlet/low outlet operating pressure, and across a broad range of operating torques. By removing the permanent drive shaft and associated bushing from the pump, the size of the pump is significantly reduced. The number of components in the pump is likewise reduced, which reduces manufacturing and serving of the pump and the useful life of the pump.

The principles, preferred embodiments and modes of operation of the present invention have been described in the foregoing specification. The invention which is intended to be protected herein should not, however, be construed as limited to the particular form described as it to be regarded as illustrative rather than restrictive. Variations and changes may be made by those skilled in the art without departing from the scope and spirit of the invention as set forth in the appended claims.

What is claimed is:

1. A metering pump, comprising:

a first circular gear having external gear teeth around the periphery thereof, said first gear having a central opening to receive a drive shaft and being rotatable by said drive shaft around a first axis;

a second circular gear having external gear teeth around the periphery thereof, said second gear rotatable around a second axis;

a housing including first and second housing plates enclosing the first and second gears, one of the housing plates having a central opening aligned with the central opening in the first gear, and the first and second housing plates having inner wall surfaces closely adjacent opposite side surfaces of the first and second gears, said first and second gears being rotatably supported within the housing such that the axis of the gears are parallel to one another and certain of the gear teeth of the two gears mesh together within a gear teeth chamber when the gears rotate;

a first port in the housing providing an inlet fluid flow to an inlet discharge groove in the inner wall of the first housing plate and into the gear teeth chamber to provide fluid to an inlet side of the meshing gear teeth, and a second port in the housing providing an outlet fluid flow from an outlet discharge groove in the inner wall of the second housing plate from the gear teeth chamber to direct fluid from an outlet side of the meshing teeth, a centerline defined between the geometric axis of the first gear and the geometric axis of the second gear, where the inlet discharge groove is located on one side of the centerline, and an inlet pressure balancing groove in the inner wall of the first housing plate is located symmetrically on another side of the centerline for pressure balancing purposes, and where the outlet discharge groove is located on the other side of the centerline, and an outlet pressure balancing groove in the inner wall of the second housing plate is located symmetrically on the one side of the centerline for pressure balancing purposes, and an annular resilient sealing element disposed against each side surface of the first gear, surrounding the central opening in the first gear and fluidly sealing to the respective surfaces of the first gear during rotation of the gears to prevent fluid leakage into the central opening of the first gear.

2. The metering pump as in claim 1, wherein said annular sealing elements each comprise an annular face-type lip seal.

3. The metering pump as in claim 2, wherein each of said lip seals has a U-shape in cross-section, facing radially outward from the central axis of the first gear, with an inner wall of each of the lip seals disposed against the respective side surface of the first gear.

4. The metering pump as in claim 3, wherein said lip seals have an outer wall disposed against the respective internal wall surface of the adjacent housing plate, one of said lip seals sealing around the central opening in the one housing plate.

5. The metering pump as in claim 4, wherein the lip seals are each disposed within annular channels formed in the side surfaces of the respective housing plates.

6. The metering pump as in claim 5, further including a drive shaft from a prime mover extending through the central opening in one housing plate, and disposed within the central drive shaft opening of the first gear and operatively connected directly to the first gear, said drive shaft being supported entirely by the first gear without any additional bushing structure within the housing.

7. The metering pump as in claim 6, wherein the lip seals are spaced-apart from the drive shaft.

8. The metering pump as in claim 1, wherein the housing plates comprise the outermost walls of the housing.

9. The metering pump as in claim 1, wherein the drive shaft can be inserted into the central opening, and removed therefrom, without disassembling the housing plates.

10. The metering pump as in claim 1, further including a gear plate interposed between the housing plates, the gear plate including a major opening closely surrounding the first gear, and a minor opening closely surrounding the second gear, the major and minor openings intersecting in the area of the gear teeth chamber, and a pair of semi-circular curved pockets formed in the gear plate in the area of intersection, the pockets opening inwardly toward the intermeshing teeth, and smoothly intersecting the major and minor openings, wherein the pockets provide pressure balancing for the gears during operation.

11. The metering pump as in claim 10, wherein the pockets are respectively fluidly aligned with the inlet and outlet discharge grooves in the housing plates, one of the pockets being fluidly aligned with the inlet discharge groove in the first housing plate and the outlet pressure balancing groove in the second housing plate; and the other of the pockets being fluidly aligned with the outlet discharge groove in the second housing plate and the inlet pressure balancing groove in the first housing plate.

* * * * *